United States Patent [19]

Yoshinaga

[11] 4,288,209

[45] Sep. 8, 1981

[54] GAS CIGARETTE LIGHTER WITH SOLAR CELL

[75] Inventor: Sadao Yoshinaga, Tokyo, Japan

[73] Assignee: Prince Industrial Development Co., Ltd., Tokyo, Japan

[21] Appl. No.: 16,190

[22] Filed: Feb. 28, 1979

[30] Foreign Application Priority Data

Mar. 2, 1978 [JP] Japan ..... 53-26870
May 29, 1978 [JP] Japan ..... 53-72473

[51] Int. Cl.[3] ..... F23Q 7/12
[52] U.S. Cl. ..... 431/255; 431/143; 431/150
[58] Field of Search ..... 431/132, 150, 255, 264, 431/266

[56] References Cited

U.S. PATENT DOCUMENTS 3,837,787 9/1974 Remy et al. ..... 431/255
3,918,887 11/1975 Lamprecht et al. ..... 431/255
4,089,636 5/1978 Goto ..... 431/255

*Primary Examiner*—Carroll B. Dority, Jr.
*Attorney, Agent, or Firm*—Weingarten, Maxham & Schurgin

[57] ABSTRACT

A gas cigarette lighter for igniting a liquified gas fed out of the combustion valve by applying electric sparks thereto which are generated by the discharge circuit connected to a secondary cell is provided with a solar cell as a supplementary electric source for the secondary cell. The solar cell can be inserted into the lighter casing without increasing the volume of the latter, and the secondary cell can be charged not only with light from the sun but also with light from a fluorescent lamp.

5 Claims, 8 Drawing Figures

GAS CIGARETTE LIGHTER WITH SOLAR CELL

BACKGROUND OF THE INVENTION

This invention relates to gas cigarette lighters, and more particularly to a gas cigarette lighter utilizing a solar cell.

A conventional gas cigarette lighter using a cell as its electric source is disadvantageous in that, unlike a gas cigarette lighter employing a semi-permanently serviceable piezoelectric element as its electric source, the service life of the cell is limited. The service life of the cell is relatively short, although it depends on the frequency of use of the lighter. Accordingly, it is necessary to replace the cell with a new one whenever its service life is ended. However, if it is possible to charge the cell by some means, the service life thereof is increased as much, that is, one cell can be used for a long period of time. In view of the foregoing, the inventor has reached the present invention in which the solar energy is converted into electrical energy to charge the cell, so as to supplement the electrical energy which is consumed for every operation of the lighter.

Utilization of the solar energy is well known in the art. Conversion of the solar energy into electrical energy for providing a power source or an optical source has been developed in a number of industrial fields and is actually used in some of the industrial fields. However, as the conversion of the solar energy into electrical energy needs intricate means, it goes without saying that it is impossible to apply the device which has been developed already, as it is, to a gas lighter which is so small in size that it can be completely covered by a hand.

A discharge type gas lighter having a cell is considerably intricate in internal structure, and the cell, a capacitor and a high voltage transformer necessary for generating electric sparks are incorporated therein at the cost of the volume of the fuel tank. Therefore, it is not preferable to further decrease the volume of the fuel tank to provide a solar cell in the lighter casing; that is, it is necessary to increase the volume of the lighter casing for the provision of the solar cell. However, this means an increase of the volume of the lighter itself, and is therefore unpreferable for a portable gas lighter in which the cap is opened and closed and the switching operation is effected by one hand.

SUMMARY OF THE INVENTION

Accordingly, in a gas cigarette lighter according to this invention, the volume of the lighter casing is no longer than that of a conventional discharge-type one, and yet a solar cell is built into the lighter casing so that its original cell can be used for a long period of time by charging it with the electrical energy converted from the solar energy.

A first object of the invention is to provide a discharge-type gas cigarette lighter in which the largest surface of the lighter casing is utilized as a light receiving surface, for a solar cell unit to sufficiently charge the original cell with the electrical energy converted from the solar energy through the solar cell unit, and the charging of the cell can be effected not only with light from the sun but also light from a fluorescent lamp.

A second object of the invention is to provide a discharge-type gas cigarette lighter in which a number of solar cell elements and an over-charge preventing circuit are provided on an insulating panel as one unit, and this unit together with a fuel tank and a discharge unit is inserted into the lighter casing in such a manner that the solar coil elements appear in a light receiving window and are electrically connected to the discharge circuit, thereby to charge the original coil.

A third object of the invention is to provide a discharge-type gas cigarette lighter in which positioning of a light receiving window formed in one side of the lighter casing and solar cell elements can be readily achieved by the use of a guide member, a discharge unit can be sufficiently coupled to a solar cell unit merely by engaging holes with protrusions, the components in the lighter are not shifted by vibration or the like, and the components can be readily assembled and disassembled.

The novel features which are considered characteristic of this invention are set forth in the appended claims. This invention itself, however, as well as other objects and advantages thereof will be best understood by reference to the following detailed description of illustrative embodiments, when read in conjunction with the accompanying drawings, in which like parts are designated by like reference numerals or characters.

Figure 1:
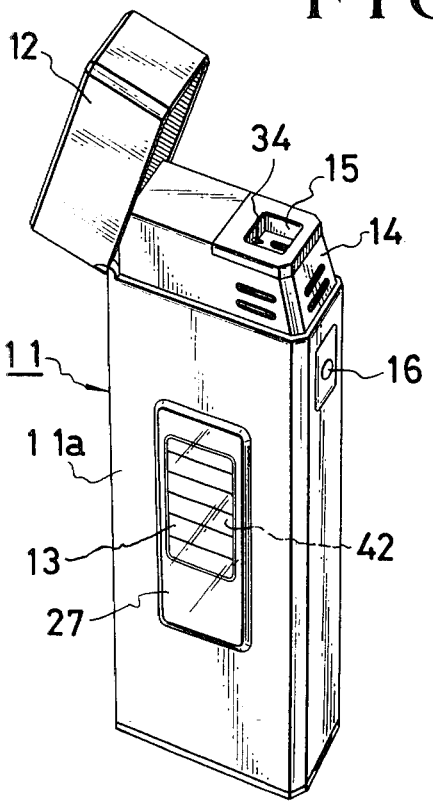
FIG. 1 is a perspective view showing a cigarette lighter with the cap opened, according to this invention.

One example of a gas cigarette lighter according to this invention, as shown in FIG. 1, comprises a parallelepiped light receiving window 13 on the front wall 11*a* thereof. The light receiving window 13 is extended longitudinally of the front wall 11*a*. There is a flame section 15 surrounded by a cover 14 with air holes at the upper portion of the lighter, which is covered by the cap 12. An ignition switch 16 is provided at the upper portion of one side wall of the casing. The switch 16 is exposed so as to be operated by touching it with the finger.

Figure 2:
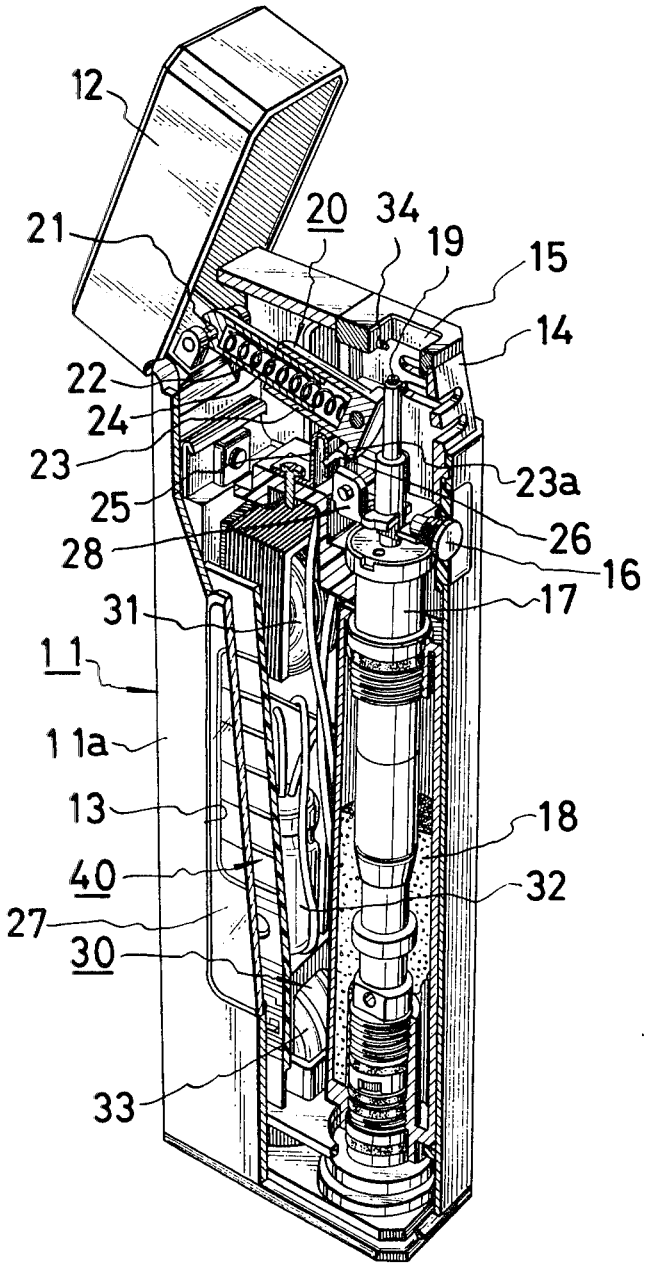
FIG. 2 is also a perspective view showing a part of the internal structure of the cigarette lighter according to the invention, with the lighter casing partly cut away.

As shown in FIG. 2, a fuel tank 18 with a combustion valve 17, a compact discharging unit 30 having a high voltage transformer 31, a capacitor 32, a discharging cell 33 used as a secondary cell, which are electrically interconnected, and a solar cell unit 40 are built into the lighter casing 11.

A positive (+) electrode 34 electrically connected to the high voltage transformer 31, and a nozzle 19 operating as a negative (−) electrode which forms the upper part of the combustion valve and is located in the flame section 15 are protruded inside the cover 14 so that an electric spark is generated in the gas atmosphere of a liquified gas which flows out of the top of the nozzle.

Furthermore, a means 20 for opening and closing the cap 12 is provided inside the upper portion of the lighter casing 11.

This means 20 is made up of a plunger 22, one end of which is engaged with a shaft 21 provided at the pivotal portion of the cap 12, and a cylinder 23 which is swingably supported on a shaft. The plunger 22 is moved longitudinally (contracted and expanded) by means of a spring 24 loaded between the plunger 22 and the cylinder 23 whenever the cap 12 is opened or closed manually, so that the cap 12 is elastically maintained opened or closed.

A protrusion 23*a* is extended downwardly from the portion of the cylinder 23 where its shaft is provided. When the cap 12 is opened, the protrusion 23*a* is moved, as a result of which a curved contact piece 25 and a terminal 26, which form the primary switch of the discharging unit 30, are brought into contact with each other to close the discharge circuit, while a member 28 is depressed to lift the aforementioned nozzle 19 to open the combustion valve 17 to allow the liquified gas to flow out.

Figure 3:
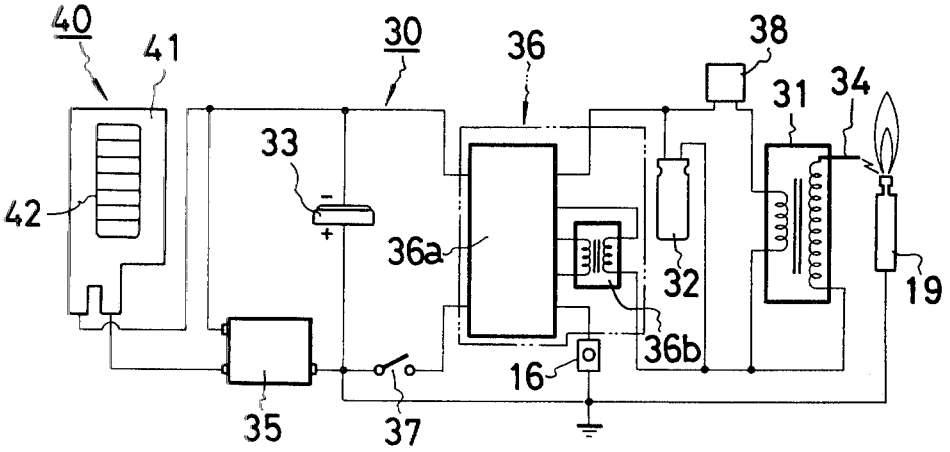
FIG. 3 is a pictorial circuit diagram, partly as a block diagram, showing a discharge circuit with a solar cell unit.

FIG. 3 shows the discharging unit 30 which is built into the lighter casing 11 together with the solar cell. The discharging unit 30 comprises: a secondary cell 33 (or a silver oxide cell) employing a solar cell 42 on the panel 41 of a solar cell unit 40 as a supplementary cell; an over-charge preventing circuit 35 connected between the solar cell 42 and the secondary cell 33; a high voltage generating circuit 36 including a control section 36*a* in the form of an integrated circuit and an oscillating transformer 36*b*, the control section 36*a* made up of a transistor inverter and a rectifier circuit, the high voltage generating circuit adapted to increase the voltage (1.5 V for instance) of the secondary cell 33 to a required voltage (100 V for instance); a primary switch 37 consisting of the curved contact piece 25 and the terminal 26, the primary switch 37 being connected to the input side of the high voltage generating circuit 36, so that it is closed when the cap 12 is opened; the aforementioned capacitor 32 charged by the output voltage of the high voltage generating circuit 36; the high voltage transformer 31 for supplying a high voltage to the positive electrode 34; a bidirectional 2-terminal thyristor 38 connected between the high voltage transformer 31 and the capacitor 32, the thyristor 38 being turned on when the voltage of the capacitor charged reaches a predetermined value; and the above-described switch 16 provided on the side wall of the lighter casing, the switch 16 adapted to apply an operation instruction to the high voltage generating circuit 36 thereby to cause electric sparks between the nozzle 19 and the positive electrode.

The charge current is consumed as electric sparks when the ignition switch 16 is operated after the primary switch 37 is closed by opening the cap 12. In this operation, the high voltage generating circuit 36 is operated in such a manner that the current is converted into AC current by means of the inverter and the AC current is converted into DC current, as a result of which a DC voltage increase is provided at the output terminal of the high voltage generating circuit. This DC voltage is applied to the capacitor 32 to charge the latter capacitor 32. When the voltage of the capacitor 32 reaches the predetermined value, the two-terminal thyristor 38 is turned on, and the charges in the capacitor 32 are therefore discharged into the primary winding of the ignition transformer 31. As a result of this discharge, a high voltage is induced in the secondary winding of the transformer 31 and is applied to the electrode 34. Accordingly, an electric spark is caused between the electrode 34 and the nozzle 19 to ignite the liquified gas.

Figure 4:
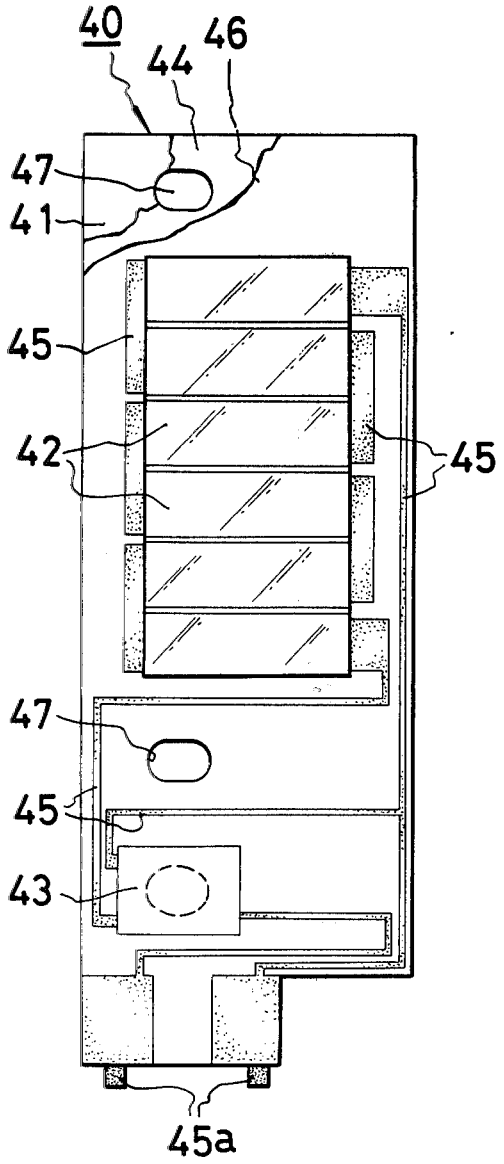
FIG. 4 is a front view of the solar cell unit with a part removed.
Figure 5:
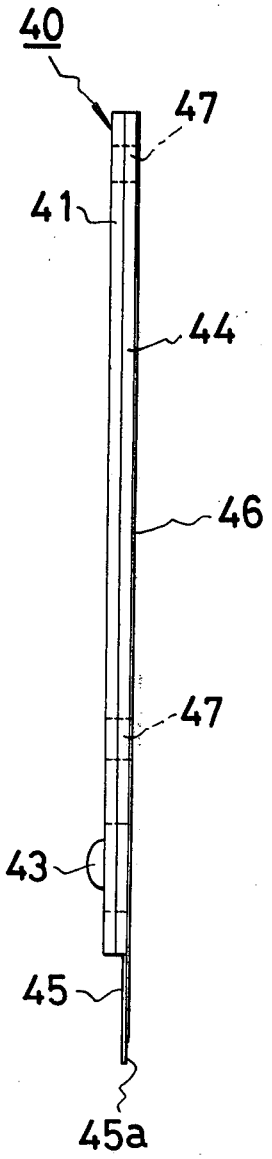
FIG. 5 is a side view of the solar cell unit shown in FIG. 4.

The solar cell unit 40, as shown in FIGS. 4 and 5, comprises: an insulating panel 41, elongated, rectangular solar cell elements 42; an IC (integrated circuit) 43 for control; a printed circuit board 44 on which conductors 45 are printed; and a protective film 46.

Each of the solar cell elements 42 has a positive electrode at one end and a negative electrode at the other end. For instance six solar cell elements 42 are arranged in one row on the printed circuit board in such a manner that a negative electrode is connected to a positive electrode, the positive electrode is connected to another negative electrode, and so on, and the electrodes are on both sides of the row. In other words, the solar cell elements are series-connected by the conductors 45 when the solar cell elements are bonded to the printed circuit board 44. The group of solar cell elements are provided between the insulating panel 41 and the printed circuit board 44 covered with the protective film 46 in such a manner that the light receiving surfaces thereof appear in the rectangular opening formed in the printed circuit board 44 covered by the protective film 46.

The integrated circuit 43 for control is interposed in the conductors 45 on the printed circuit board. This integrated circuit 43 is to prevent the over-charge of the secondary cell connected to the connection terminals 45*a* of the conductors 45. The integrated circuit 43 shown in FIGS. 4 and 5 corresponds to the over-charge preventing circuit 35 in FIG. 3.

The solar cell unit provided in the form of a thin plate can be fixedly inserted into a small clearance (less than 1 mm) between the lighter casing 11, and the fuel tank 18 and the discharging unit by utilizing very simple means. The simple means are mounting holes formed in the upper and lower portions of the solar cell unit 40, and protrusions 39*a* provided in the upper and lower portions of the cover 39 of the discharging unit 30.

Various methods of mounting the solar cell unit 40 on the rear side of the light receiving window 13 in which a window glass is fitted will be described with reference to FIGS. 6, 7 and 8.

Figure 6:
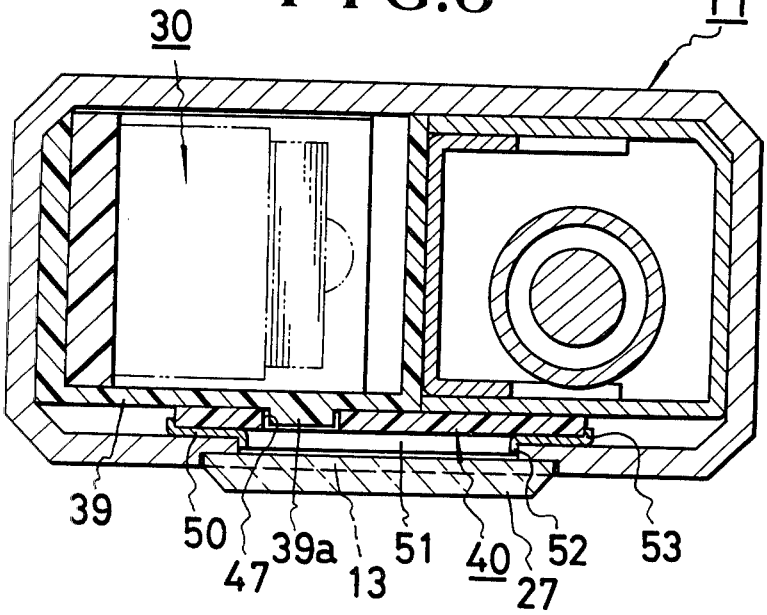
FIG. 6 is a transverse sectional view of the cigarette lighter.

In the case of FIG. 6, the protrusions 39*a* formed on the discharging unit cover 39 are inserted into the mounting holes 47 so that the solar cell unit 40 is on the cover 39. The assembly of the solar cell unit 40 and the cover 39 is mounted by being guided by a guide plate 50 fitted in the light receiving window 13, so that the group of solar cell elements are positioned on the rear side of the window glass 27. The guide plate 50 is made of a thin metal plate and has an opening 51 to expose the group of solar cell elements. Both sides of the opening 51 have bent pieces 52 which are fitted in the light receiving window, and the outer sides of the guide plate are bent along the guide 53 of the solar cell unit 40. After the guide plate 50 is fitted in the light receiving window 13 from inside the lighter casing 11, the solar cell unit 40 together with the discharging unit 30 is inserted by means of the cover 39 into the lighter casing through the opening formed in the bottom thereof. Therefore, the solar cell unit 40 is placed on the rear side of the light receiving window 13. That is, the solar cell unit 40 is fixedly secured in place by means of the protrusions 39*a* of the cover 39 and the guide plate 50, if the relevant dimensions are substantially correct.

Figure 7:
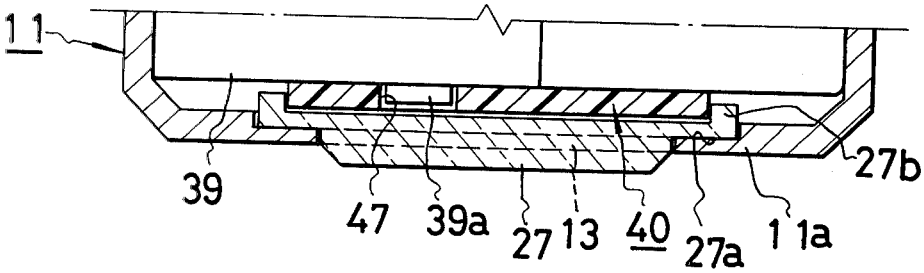
FIGS. 7 and 8 are transverse sectional views of parts of cigarette lighters according to the invention, showing the constructions of mounting the solar cell unit.

In a mounting structure shown in FIG. 7, the window glass 27 is employed as a guide, thereby to eliminate the guide plate 50 shown in FIG. 6. In this case, fitting steps 27*a* are formed on both sides of the window glass 27, and the outer sides of the fitting steps are extended to form the guide sides 27*b* of the solar cell unit 40. The window glass is fitted in the light receiving window 13 from inside the lighter casing.

Figure 8:
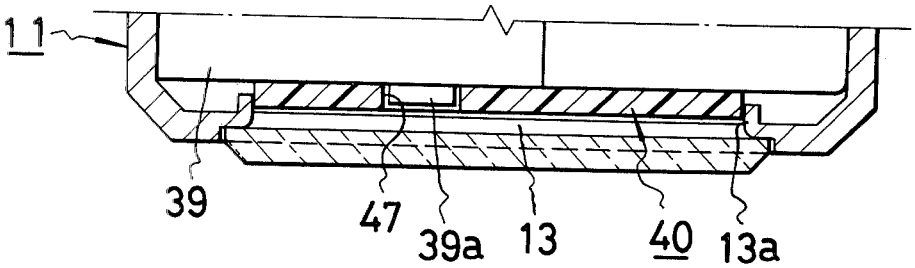

In a mounting structure shown in FIG. 8, both inner sides 13*a* of the light receiving window 13 are bent inwardly to be used as a guide. In this case, the solar cell unit 40 can be correctly positioned in the light receiving window 13 without the guide plate 50.

With the solar cell unit 40 thus positioned in the light received window 13, light receiving from the outside is converted into electrical energy by a number of solar cell elements 42, and the electrical energy is applied to the above-described discharge circuit 30 where it is charged in the secondary cell 33.

If it is assumed that the lighter is operated twenty times a day for smoking, the discharge interval is 0.5 second, and the discharge is effected twice for each ignition, then the time required for charging the secondary cell 33 for one day is as follows:

1. Fine Weather (Intensity of illumination 80,000–100,000 luxes)
   Charge time: 5.5–4.5 minutes
   Charge current: 3.0–3.7 mA
2. Cloudy Weather (Intensity of illumination 20,000–30,000 luxes)
   Charge time: 22.2–15.2 minutes
   Charge current: 0.19–0.37 mA
3. Indoor Illumination Light (Intensity of illumination 1,000 Luxes)
   Charge time: 7 hours
   Charge current: 0.04 mA

What is claimed is:

1. A gas cigarette lighter comprising:

a casing having an opening in one side thereof;

a fuel tank mounted within said casing;

a nozzle through which the gas flows when the lighter is actuated, said nozzle being coupled to said fuel tank;

an electrical circuit comprising a discharge means;

electrical storage means connected as part of said discharge means;

a solar cell unit formed as a thin plate having at least one hole therein, said solar cell unit having at least one solar cell and being connected to said discharge means so as to electrically charge said electrical storage means;

an ignition switch in one wall of said casing;

a cover for said discharge means;

at least one protrusion on said cover, said solar cell unit being mounted to said cover of said discharge means with said protrusion extending into said hole in said plate; and guide means framing at least part of said opening in said casing, said guide means positively retaining said solar cell unit so that said solar cell element is aligned with said opening in said casing to facilitate reception of light energy by said solar cell element when said discharge means, cover and solar cell unit are mounted in said casing.

2. A gas cigarette lighter as claimed in claim 1, in which said solar cell unit is in the form of a thin plate which is formed by bonding an insulating plate to a printed circuit board, said insulating plate having a necessary number of solar cell elements which have each a positive electrode at one end and a negative electrode and are arranged in one row on one surface thereof in such a manner that said electrodes are aligned with both sides of said one row with the electrodes different in polarity confronted with one another, said printed circuit board having printed conductors for series-connecting said solar cell elements, and in which a control integrated circuit to prevent over-charge of said electrical storage means is interposed in said conductors.

3. A gas cigarette lighter as claimed in claim 1 wherein said guide means for said solar cell unit are formed as part of both sides of a window glass fitted in said casing opening.

4. A gas cigarette lighter as claimed in claim 1 wherein said guide means for said solar cell unit are formed brackets on both sides of said casing opening.

5. A gas cigarette lighter having a casing and a cap pivotally mounted thereto, a fuel tank within said casing and a nozzle coupled to the fuel tank, and an opening in one side of the casing, said lighter comprising:

a discharge circuit mounted in said casing comprising:

a solar cell;

a secondary cell employing said solar cell as a supplementary electric source;

an over-charge preventing circuit connected between said solar cell and said secondary cell;

a high voltage generating circuit for increasing the voltage of said secondary cell to a predetermined value;

a primary switch connected to the input side of said high voltage generating circuit, said primary switch being closed when said cap of said lighter is opened;

a capacitor charged by the output of said high voltage generating circuit;

a positive electrode confronted with said nozzle serving also as a negative electrode;

a transformer for supplying a high voltage to said positive electrode;

a bi-directional two-terminal thyristor connected between said transformer and said capacitor, said thyristor being turned on when the voltage of said capacitor reaches a predetermined value; and an ignition switch for applying an operation instruction to said high voltage generating circuit when touched;

a cover for said discharge circuit;

at least one protrusion on said cover;

a thin plate to which said solar cell is mounted, said plate being formed with at least one hole therethrough, said plate being mounted to said cover with said protrusion extending into said hole; and guide means framing at least part of said casing opening, said guide means positively retaining said solar cell in alignment with said casing opening to facilitate reception of light energy by said solar cell when said discharge circuit, cover and solar cell are mounted in said casing.

* * * * *